US005865933A

United States Patent [19]

Morin et al.

[11] Patent Number: 5,865,933

[45] Date of Patent: Feb. 2, 1999

[54] METHOD FOR SELECTIVELY CARVING COLOR CONTRASTING PATTERNS IN TEXTILE FABRIC

[75] Inventors: Brian Gerald Morin, Greenville; Paul William Eschenbach, Moore; Howard Christy Willauer, Spartanburg, all of S.C.

[73] Assignee: Milliken Research Corporation, Spartanburg, S.C.

[21] Appl. No.: 745,719

[22] Filed: Nov. 12, 1996

[51] Int. Cl.[6] ..... B32B 31/20

[52] U.S. Cl. ..... 156/272.8; 156/209; 156/308.4

[58] Field of Search ..... 156/209, 308.4, 156/272.8; 28/159, 160

[56] References Cited

U.S. PATENT DOCUMENTS

| | | |
|---|---|---|
| 304,417 | 9/1884 | Fletcher . |
| 1,603,723 | 10/1926 | Stetten . |
| 1,889,902 | 12/1932 | Moore . |
| 2,110,118 | 3/1938 | Robertson et al. . |
| 2,119,057 | 5/1938 | Richa . |
| 2,241,222 | 5/1941 | Sonnino . |
| 2,563,259 | 8/1951 | Miller . |
| 2,723,937 | 11/1955 | Rice . |
| 2,875,504 | 3/1959 | White . |
| 2,988,800 | 6/1961 | White . |
| 3,010,179 | 11/1961 | Thal . |
| 3,153,106 | 10/1964 | Schlick . |
| 3,171,484 | 3/1965 | Thal . |
| 3,214,819 | 11/1965 | Guerin . |
| 3,256,581 | 6/1966 | Thal et al. . |
| 3,353,225 | 11/1967 | Dodson . |
| 3,357,074 | 12/1967 | Allman et al. . |
| 3,403,862 | 10/1968 | Dworjanyn . |
| 3,434,188 | 3/1969 | Summers . |
| 3,443,878 | 5/1969 | Weber et al. . |
| 3,448,501 | 6/1969 | Buzano . |
| 3,452,412 | 7/1969 | Allman, Jr. et al. . |
| 3,458,905 | 8/1969 | Dodson, Jr. et al. . |
| 3,494,821 | 2/1970 | Evans . |
| 3,508,308 | 4/1970 | Bunting, Jr. et al. . |
| 3,585,098 | 6/1971 | Truscott et al. . |
| 3,613,186 | 10/1971 | Mazzone et al. . |
| 3,635,625 | 1/1972 | Voss . |
| 3,729,784 | 5/1973 | Mazzone et al. . |
| 3,750,237 | 8/1973 | Kalwaites . |
| 3,768,118 | 10/1973 | Ruffo et al. . |
| 3,774,272 | 11/1973 | Rubaschek et al. . |
| 3,842,468 | 10/1974 | Harrison . |
| 3,862,291 | 1/1975 | Brandon, Jr. et al. . |

(List continued on next page.)

FOREIGN PATENT DOCUMENTS

| | | |
|---|---|---|
| 233019 | 2/1961 | Australia . |
| 766310 | 9/1971 | Belgium . |
| 653805 | 12/1962 | Canada . |
| 2056210 | 5/1972 | Germany . |
| 3613070 | 4/1986 | Germany . |
| 851473 | 10/1960 | United Kingdom . |
| 978452 | 12/1964 | United Kingdom . |
| 1101899 | 12/1965 | United Kingdom . |
| 1012963 | 11/1969 | United Kingdom . |
| 1172289 | 11/1969 | United Kingdom . |
| 1171548 | 2/1971 | United Kingdom . |
| 1353183 | 2/1971 | United Kingdom . |
| 1321236 | 6/1973 | United Kingdom . |
| 2088424 | 6/1982 | United Kingdom . |

*Primary Examiner*—James J. Bell
*Attorney, Agent, or Firm*—Terry T. Moyer; George M. Fisher

[57] ABSTRACT

An apparatus and method for creation of a textile fabric that has been patterned with a selective application of heat, which provides a carved portion in registry with a color change. The textile fabric includes a blend of fibers of a first polymer having a first color with fibers of a second polymer having fibers of a second color. The melting point of the first fibers exceeds that of the second fibers. When patterned with a selective application of heat that exceeds that of the second fibers but is less than that of the first fibers, the second fibers melt away leaving the first fibers with the first color dominating. In the uncarved areas, the resulting color is a blend of the first color and the second color.

16 Claims, 7 Drawing Sheets

U.S. PATENT DOCUMENTS

| | | |
|---|---|---|
| 3,875,975 | 4/1975 | Lee, Jr. . |
| 3,880,201 | 4/1975 | Lee, Jr. et al. . |
| 3,881,131 | 4/1975 | Gamarra et al. . |
| 3,916,823 | 11/1975 | Halloran . |
| 3,924,040 | 12/1975 | Addie et al. . |
| 3,969,779 | 7/1976 | Stewart, Jr. . |
| 4,002,013 | 1/1977 | Johnson et al. . |
| 4,007,071 | 2/1977 | Addie et al. . |
| 4,059,880 | 11/1977 | Klein . |
| 4,274,182 | 6/1981 | Greenway . |
| 4,312,293 | 1/1982 | Hakim . |
| 4,323,760 | 4/1982 | Greenway et al. . |
| 4,332,063 | 6/1982 | Ehrhardt . |
| 4,335,178 | 6/1982 | Fearing . |
| 4,364,156 | 12/1982 | Greenway et al. . |
| 4,393,562 | 7/1983 | Stokes . |
| 4,444,831 | 4/1984 | Leitner . |
| 4,471,514 | 9/1984 | Stokes . |
| 4,473,609 | 9/1984 | Caldwell . |
| 4,499,637 | 2/1985 | Greenway . |
| 4,670,317 | 6/1987 | Greenway . |
| 5,148,583 | 9/1992 | Greenway . |
| 5,178,939 | 1/1993 | Caldwell . |
| 5,202,077 | 4/1993 | Marco et al. . |
| 5,418,045 | 5/1995 | Pike et al. . |

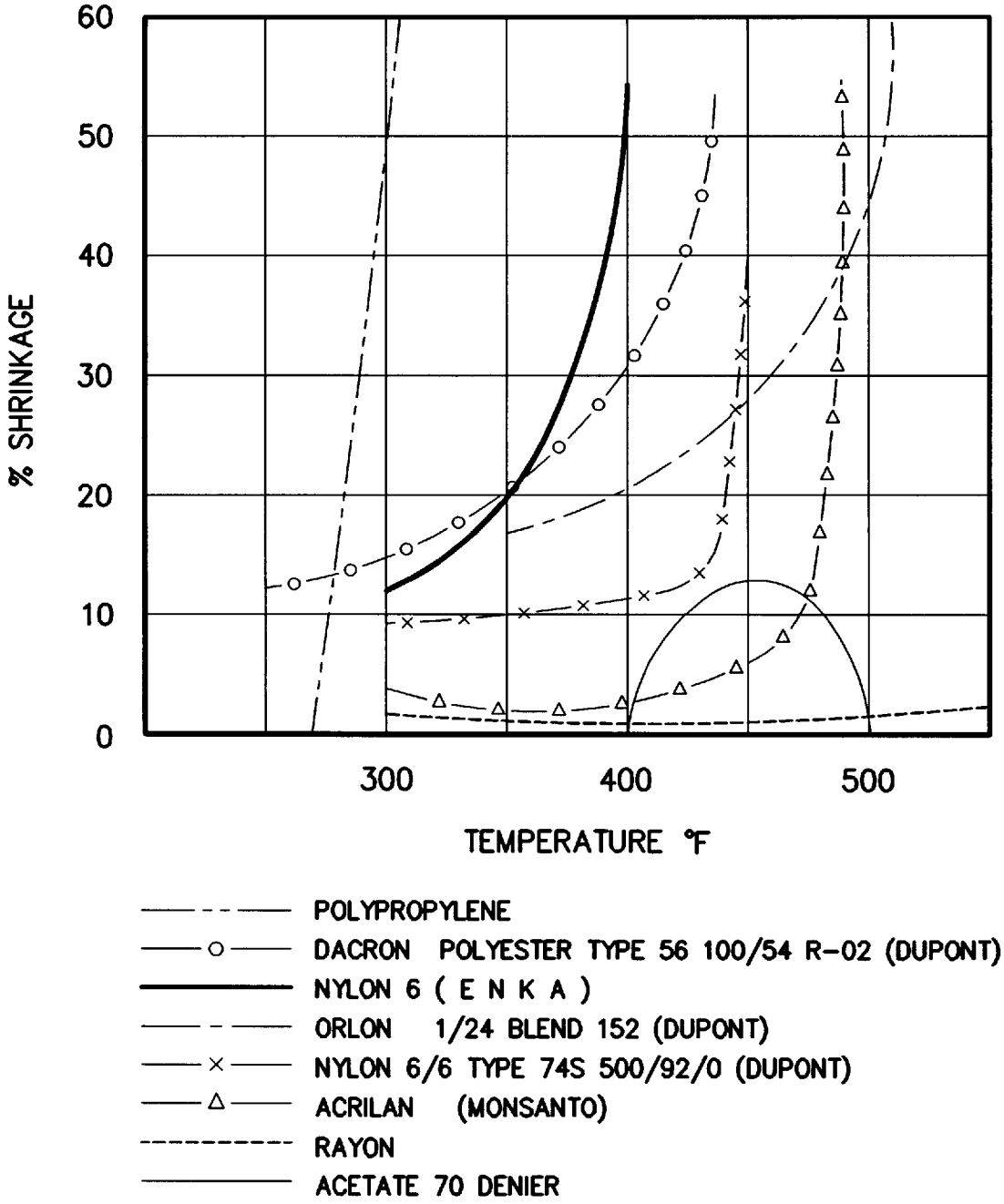
*FIG. —9—*

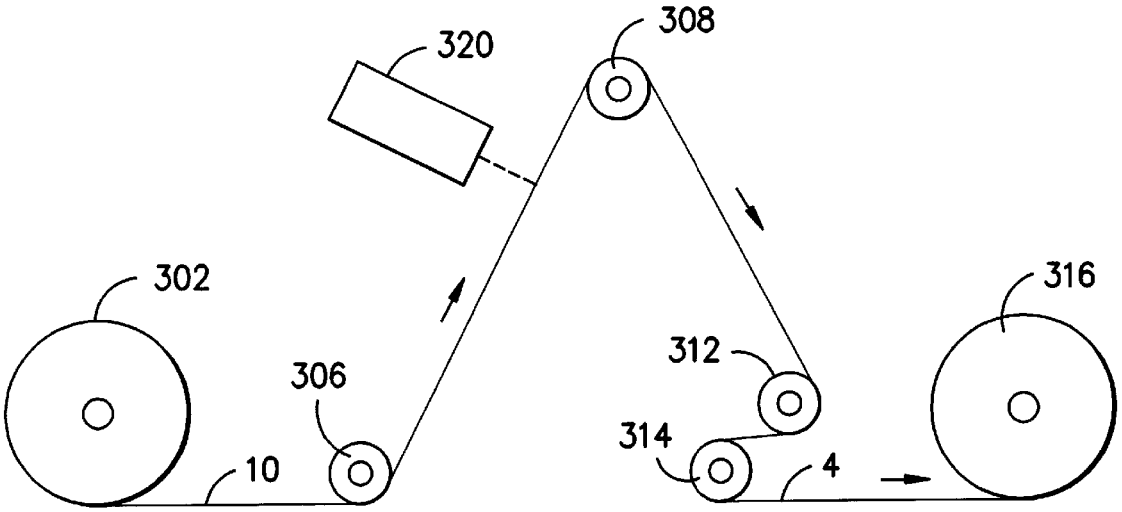
FIG. –10–
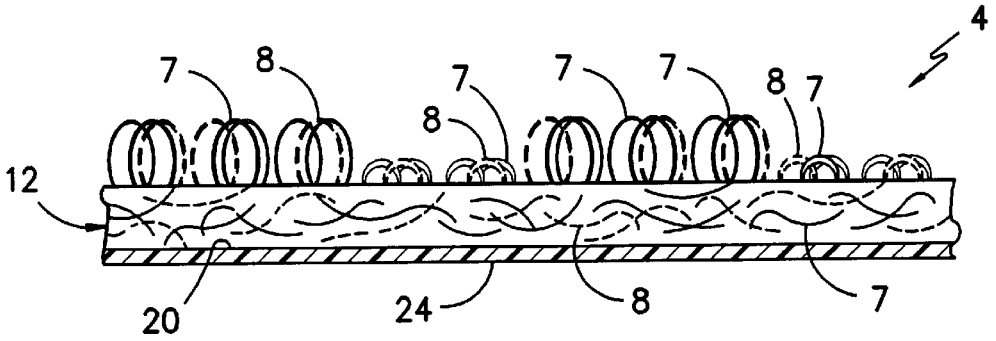
FIG. –11–

METHOD FOR SELECTIVELY CARVING COLOR CONTRASTING PATTERNS IN TEXTILE FABRIC

BACKGROUND OF THE INVENTION

This invention relates to a method and apparatus for selectively carving contrasting patterns in a textile fabric. It is extremely difficult to pattern a textile fabric to provide visual and tactile surface effects in registry with a color change. The textile fabric contains fibers that are thermally modifiable such as, including, but not limited, to rayon, nylon, polyester, polypropylene, cellulose, polyethylene of both the high and low melt variety, acetate, wool, NOMEX®, and polypyrrole treated quartz fibers.

Various apparatus have been proposed for directing heat such as heated pressurized fluid streams, such as air, onto the surface of a moving textile fabric to alter the location of or modify the thermal properties of the fibers and provide a pattern or visual and tactile surface change in such fabrics. Examples of such prior art equipment and methods of application of the pressurized fluid streams to a relatively moving material are disclosed in the following U.S. Pat. Nos: 2,110,118; 2,241,222; 2,563,259; 3,010,179; 3,403,862; 3,434,188; 3,585,098; 3,613,186. A major shortcoming of this technology is that these carved patterns created by utilizing high temperature pressurized streams of fluid, such as air, to impart visual and tactile surface patterns to textile fabrics containing thermoplastic materials by thermal modification of the same must occur in exact alignment with the previously dyed portions of the textile substrate in order to achieve the full aesthetic effect.

The present invention solves these problems in a manner not disclosed in the known prior art.

SUMMARY OF THE INVENTION

An apparatus and method for creation of a textile fabric that has been patterned with a selective application of heat, which provides a carved portion in registry with a color change. The textile fabric includes a blend of fibers of a first polymer having a first color with fibers of a second polymer having fibers of a second color. The melting point of the first fibers exceeds that of the second fibers. When patterned with a selective application of heat that exceeds that of the second fibers but is less than that of the first fibers, the second fibers melt away leaving the first fibers with the first color dominating. In the uncarved areas, the resulting color is a blend of the first color and the second color.

An advantage of this invention is to have thermally carved areas in a textile fabric that is in registry with areas of a different color.

Still another advantage of this invention is the means of carving in registry with color patterning is relatively inexpensive.

Another advantage of this invention is the means of carving in registry with color patterning is relatively uncomplicated.

These and other advantages will be in part apparent and in part pointed out below.

BRIEF DESCRIPTION OF THE DRAWINGS

The above as well as other objects of the invention will become more apparent from the following detailed description of the preferred embodiments of the invention when taken together with the accompanying drawings, in which:

FIG. 9 is a graph comparing percentage of shrinkage as a function of temperature for a number of fiber types;

FIG. 10 is a schematic side elevational view of apparatus for laser beam treatment of a moving textile fabric to impart a surface pattern or change in the surface appearance thereof; and FIG. 11 is a cross-sectional side view of needlepunched, nonwoven fabric as shown in FIG. 3, after being exposed to pressurized, heated gas.

DETAILED DESCRIPTION OF THE PREFERRED EMBODIMENT

Figure 1:
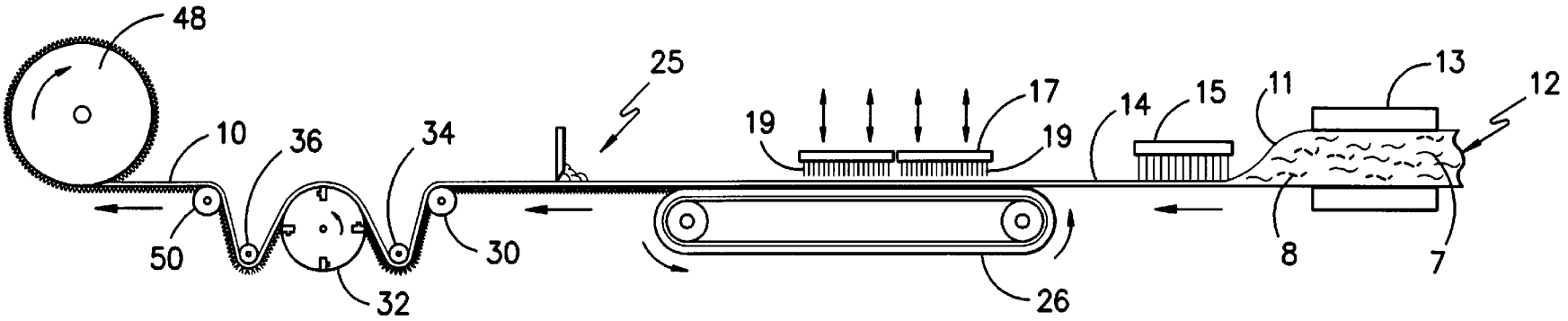
FIG. 1 is a schematic representation of a conventional process to create nonwoven fabric by needlepunching.

Referring now to the accompanying drawings, and initially to FIG. 1 that schematically represents a preferred embodiment for producing a preferred nonwoven fabric. Although a nonwoven fabric is preferred, a textile fabric as defined in this Application can include woven and knit velours, terry cloth, tufted carpet, and loop carpet, and so forth, including any fabric formed of fibers having different melting points, where it is possible to melt or carve way fibers of the lower melting point while leaving the textile substrate substantially intact. Although needling is the preferred method of creating a nonwoven fabric, this invention is by no means strictly limited to needling. FIG. 1 shows a continuous process, but obviously the fabric or webs being processed can be taken up at the end of any step in the process and carried on a roll or like to the next step in the process so long as the sequential steps of the process shown are followed.

Figure 2:
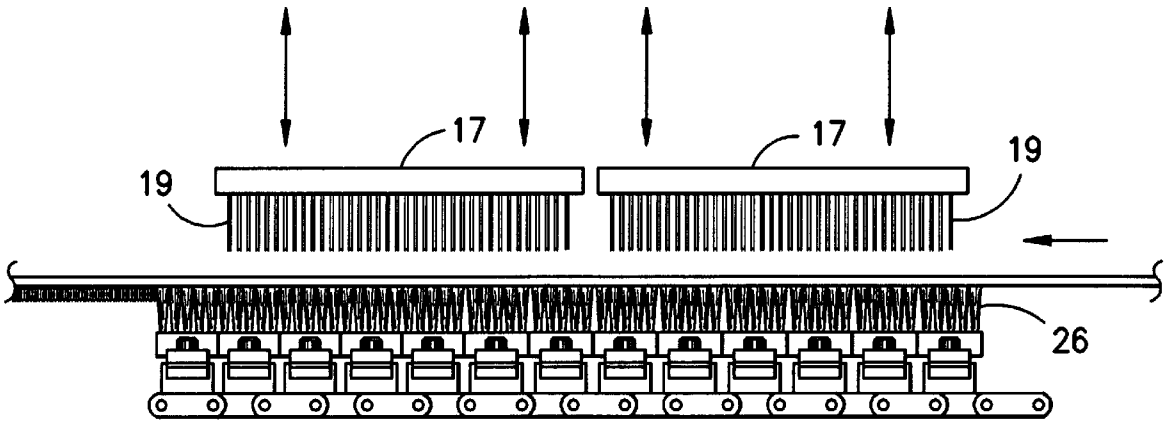
FIG. 2 is a schematic representation of the loop-forming process associated with the nonwoven fabric created by the apparatus of FIG. 1.
Figure 3:
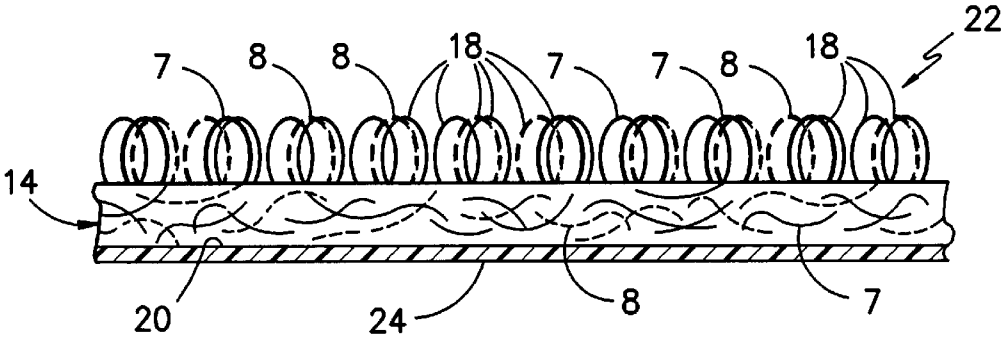
FIG. 3 is a cross-section view of the fabric with loops formed therein taken on line 3—3 of FIG. 2.

FIGS. 1, 2, and 3 illustrate one preferred form of a nonwoven fabric 10 and the method of manufacturing same. Nonwoven staple fibers 12 are laid up in a continuous web 11, as in FIG. 1, using, for instance, a conventional lapper 13 whereupon as the web 11 is advanced past a needle loom 15, it is needled into a continuous batt 14, using conventional needles. The nonwoven stable fibers 12 include a first, higher melt fibers 8 having a first color and second, lower melt fibers 7 having a second color. A typical, but nonlimiting example of first, higher melt fibers 8 includes polyester, but nylon 6, nylon 6—6, rayon, and cellulose such as cotton, acetate, and LYOSINE® would suffice. There is also a higher melt polyethylene that could function as the first, higher melt fiber 8. As an example, polyester has a melting point of 250 to 265 degrees Fahrenheit. A typical, but nonlimiting example of second, lower melt fibers 7 includes polypropylene and a lower melt polyethylene. However, if a rayon or cellulose fiber is utilized as the first, higher melt fiber, then polyester or nylon can be utilized as the second, lower melt fiber 7. As an example, polypropylene has a melting point of 170 degrees Fahrenheit. The percentage of first, higher melt fibers 8 to second, lower melt fibers 7 is in a range of ten (10) to ninety (90) percent. However, a more practical range of the percentage of first, higher melt fibers 8 to second, lower melt fibers 7 is between thirty (30) to seventy (70) percent and the preferred range of the percentage of first, higher melt fibers 8 to second, lower melt fibers 7 is between forty (40) to sixty (60) percent. The batt 14 may be needled from both sides or from one side, as shown depending upon the materials of the fibers and the desired weight of the finished fabric. In a preferred form of the steps of manufacture, and assuming that the batt 14 was needled from one side only, which was from above in FIG. 1, the needled batt 14 may be turned over or reversed before it is fed to a loop-forming needle loom 17. The turning of the batt 14 may be accomplished by rolling the batt onto a roller (not shown) as it leaves the needle loom 15, after which the roller is reversed and the batt 14 is fed to the needle loom 17 so that the batt 14 is punched from the side of the batt opposite to the single needle. If the batt 14 was needled from both sides, it is fed to the needle loom 17 oriented so that the needles penetrate first into the first punched side so that the loops project from the last-punched side. The batt 14 is advanced past the needle loom 17 where it is formed into loops 18. The needle loom 17 uses fork needles 19 which pass through one surface, such as a back surface 20, of the batt 14 to push fibers caught on the ends of the needles through another surface, such as a face surface 22, to form the loops 18 extending from said face surface.

To provide a random effect of the loops 18 as shown in FIG. 3, the forked needles are aligned in the transverse direction and staggered in the machine direction so that the openings in the loops in the machine direction are staggered from row to row in the machine. To accomplish this arrangement a brush conveyor 26 is used to allow the staggered needles to pass therethrough randomly after needling.

After the loops 18 have been formed in the batt 14 the batt 14 is moved downstream to where a backing 24, such as a coating of latex, as shown in FIG. 1, or the like, is applied to the back surface 20 using a conventional latex applicator 25 to lock the fibers 12 of the batt 14 and, if particular, the fiber ends of the loop 18 that are still in the batt and to add stiffness to the batt.

The applicator 25, as shown in FIG. 1, is a commercially available type which applies the backing 24 as the batt 14 is moved past the applicator with the backing surface facing upward.

Figure 4:
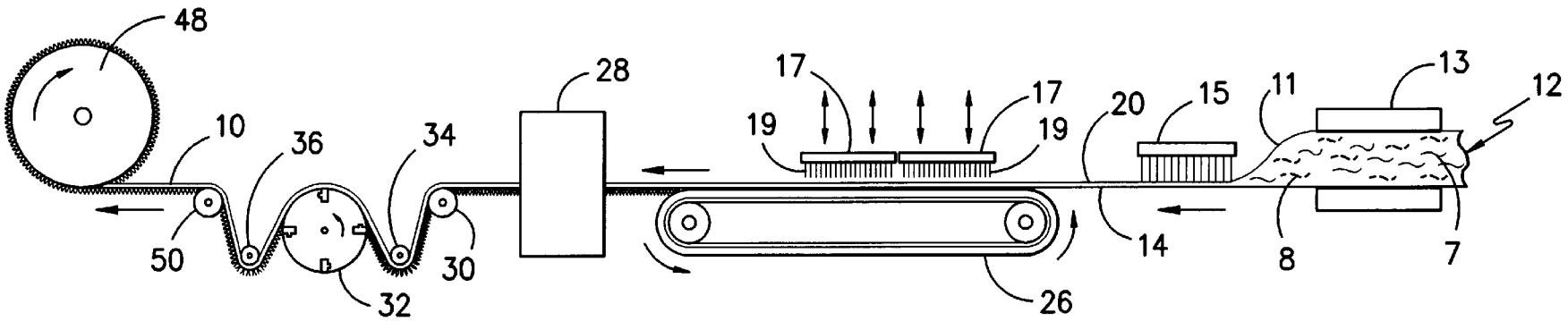
FIG. 4 is a schematic representation of a conventional process to create nonwoven fabric by needlepunching with a fused backing instead of the latex backing as shown in FIG. 1.

In place of the latex backing 24, when the nature of the material of the fibers in the batt 14 is thermoplastic or a blended composition containing fusible fibers; or the like, the back surface 20 may have the backing 26 formed by fusing (not shown) using an appropriate heat roll or oven 28 as shown in FIG. 4, or the like, which is intended to lock the ends of the fibers forming the loops and to add stiffness to the batt. The backing 26 gives strength and stability, as well as stiffness, to the finished fabric. In general, the latex backing 26 is used for high melt materials, such as nylon, acrylic, or the like, and the fused backing 26 is used with lower melt materials, such as polypropylene.

This needling technology is disclosed in U.S. Pat. No. 5,216,790 that issued Jun. 8, 1993, which is incorporated by reference as if fully set forth herein.

From the applicator 25 or the heat roll or oven 28 the backed looped batt 14, as shown in FIGS. 1 and 4, with the staggered loops 18 facing downward is passed over a guide roll 30 to the loop cutting rotor 32 of the type disclosed in U. S. Pat. No. 3,977,055 that issued Aug. 31, 1976, which is incorporated by reference as if fully set forth herein. Located on both sides of the rotor 32 are a pair of adjustable rolls 34 and 36 mounted, respectively, in support tracks 38 and 40. Support tracks allow the rolls 34 and 36 to move upward and downward to adjust the position of the looped batt 14 with respect to the blades 42 in the cutting rotor 32. As described in U.S. Pat. No. 3,977,055, the blades 42 sever almost 100% of all of the loops 18 with a minimum of waste to provide a cut pile fabric 46. The rotor 32 can be driven in the direction of travel of the looped batt 14 or opposite to the direction of travel of the batt. After the loops 18 of the batt 14 have been cut the cut pile fabric 46 is delivered to the take-up 48 by the driven roll 50 where the nonwoven fabric 10 is taken up. The range of deniers for the nonwoven fabric 10 the temperature can range between 1 to 40 denier per filament with a more practical range of 3 to 20 denier per filament and a preferred optimal range of 6 to 10 denier per filament. The range of nonwoven fabric weight can range between 4 to 40 ounces per square yard with a more practical range of 6 to 20 ounces per square yard and a preferred optimal range of 7 to 12 ounces per square yard. If the textile fabric 10 is a pile fabric the height of the pile can range from 0 to 0.6 inches with a more practical range of 0.04 to 0.32 inches and a preferred optimal range of 0.08 to 0.16 inches.

Figure 5:
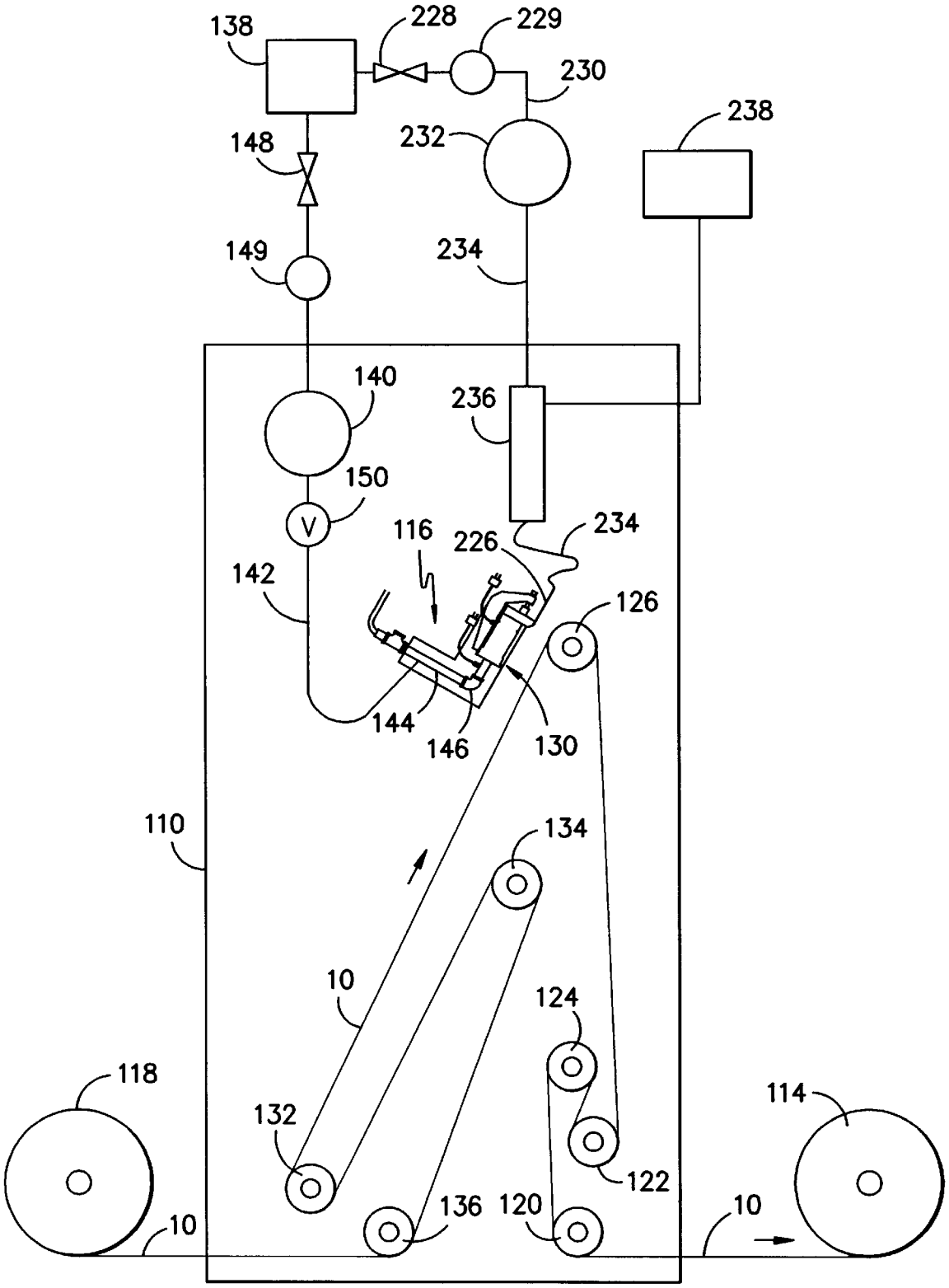
FIG. 5 is a schematic side elevation view of apparatus for heated pressurized fluid stream treatment of a moving, needled, textile fabric to impart a surface pattern or change in the surface appearance thereof.

Referring now to FIG. 5, which shows, diagrammatically, an overall side elevational view of apparatus for heated, pressurized gas stream treatment of a textile fabric 10 to carve in a patterned arrangement to melt the second, lower melt fibers 7 in a selected area and retain the first, higher melt fibers 8 in that same area so that the color of the first, higher melt fibers 8 will dominate in these select areas and the combined, resulting color from the combination of the first, higher melt fibers 8 and the second, lower melt fibers 7 will dominate in the remaining untreated areas.

As seen, the apparatus includes a main support frame including end frame support members, one of which 110 is illustrated in FIG. 5. Suitably rotatably mounted on the end support members of the frame are a plurality of textile fabric guide rolls which direct an indefinite length of textile fabric 10, from a fabric supply roll 118, past a pressurized, heated gas treating unit, generally indicated at 116. After treatment, the textile fabric 10 is collected in a continuous manner on a take-up roll 114.

As shown, textile fabric 10 from supply roll 118 passes over an idler roll 136 and is fed by a pair of driven rolls 134, 132 to a main driven textile fabric support roll 126 with the textile fabric 10 between drive roll 132 and textile fabric support roll 126 being overfed and slack with a negative tension in a range of between two and twenty percent with a preferred range of between two and twelve percent. The amount of negative tension or overfeed depends on the construction, fiber type, and other factors related to the textile fabric 10. The overfeed or negative tension must stop before the point at which puckering of the textile fabric 10 occurs. The surface of the textile fabric 10 passes closely adjacent to the heated fluid discharge outlet of an elongate fluid distributing manifold assembly 130 of treating unit 116. The treated textile fabric 4 thereafter passes over a series of driven guide rolls 122, 124 and an idler roll 120 to a take-up roll 114 for collection.

As illustrated in FIG. 5, fluid treating unit 116 includes a source of compressed gas, such as an air compressor 138, which supplies pressurized air to an elongate air header pipe 140. Header pipe 140 communicates by a series of air lines 142 spaced uniformly along its length with a bank of individual electrical heaters indicated generally at 144. The heaters 144 are arranged in parallel along the length of heated fluid distributing manifold assembly 130 and supply heated pressurized air thereto through short, individual air supply lines, indicated at 146, which communicate with assembly 130 uniformly along its full length. Air supplied to the heated fluid distributing manifold assembly 130 is controlled by a master control valve 148, pressure regulator valve 149, and individual precision control valves, such as needle valves 150, located in each heater air supply line 142. The heaters 144 are controlled in suitable manner, as by temperature sensing means located in the outlet lines 146 of each heater, with regulation of air flow and electrical power to each of the heaters to maintain the heated fluid at a uniform temperature and pressure as it passes into the manifold assembly along its full length.

Typically, for patterning textile fabrics, such as pile fabrics containing thermoplastic yarns, the heaters are employed to heat air exiting the heaters and entering the manifold assembly to a uniform temperature. The preferred operating temperature for any given textile fabric depends upon: the components of the textile fabric, the desired amount of carving effect, the speed of transport of the textile fabric, the pressure of the heated pressurized gas, the tension of the textile fabric, the proximity of the textile fabric to the treating manifold, and others. For needlepunched, textile fabric where the first fiber is polyester and the second fiber is polypropylene, the temperature can range between 300° Fahrenheit to 1,200° Fahrenheit with a more practical operating range of 375° Fahrenheit to 800° Fahrenheit and a preferred optimal range of 450° Fahrenheit to 500° Fahrenheit. This preferred optimal range will maximize the contrast between the color of the first, higher melting point fibers and the blend of higher and lower melting point fibers.

The heated fluid distributing manifold assembly 130 is disposed across the full width of the path of movement of the textile fabric and closely adjacent the surface thereof to be treated. Although the length of the manifold assembly 130 may vary, typically in the treatment of textile fabric materials, the length of the manifold assembly may be 76 inches or more to accommodate textile fabrics of up to about 72 inches in width.

Figure 6:
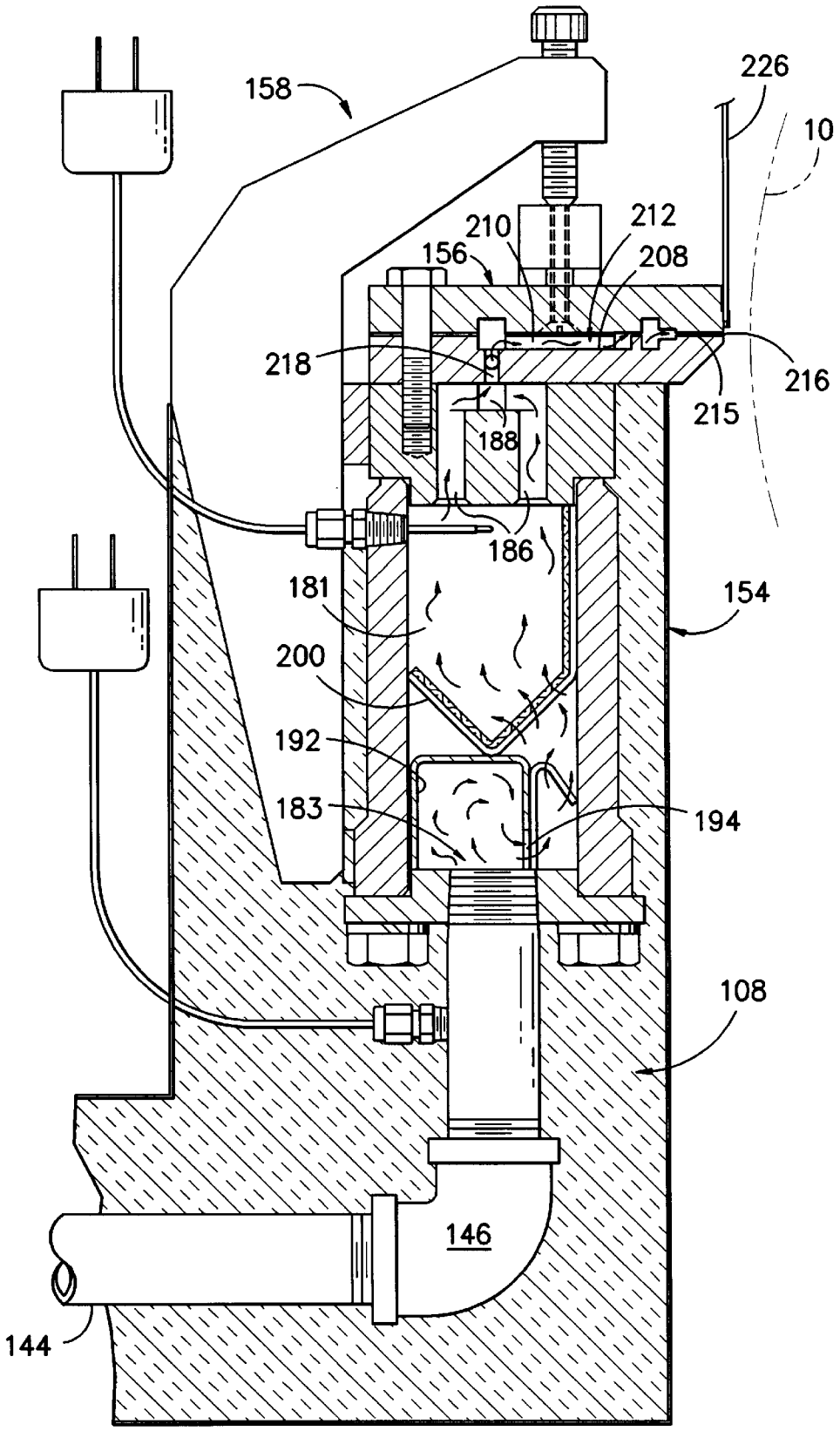
FIG. 6 is an enlarged partial sectional elevation view of the fluid distributing manifold assembly of the apparatus of FIG. 5.

Details of the heated fluid distributing manifold assembly 130 may be best described by reference to FIGS. 6, 7, and 8 of the Drawings. As seen in FIG. 6, which is a partial sectional elevation view through the assembly, there is a first large elongate manifold housing 154 and a second smaller elongate manifold housing 156 secured in fluid tight relationship therewith by a plurality of spaced clamping means, one of which is generally indicated at 158. The manifold housings 154, 156 extend across the full width of the textile fabric 10 adjacent its path of movement.

As best seen in FIG. 6, first elongate manifold housing 154 is of generally rectangular cross-sectional shape, and includes a first elongate gas receiving compartment 181, the ends of which are sealed by end wall plates suitably bolted thereto. Communicating with bottom wall plate through fluid inlet openings, one of which, 183, is shown in FIG. 6, and spaced approximately uniformly therealong are the air supply lines 146 from each of the electrical heaters 144.

The manifold housings 154, 156 are constructed and arranged so that the flow path of gas through the first housing 154 is generally at a right angle to the discharge axes of the gas stream outlets of the second manifold housing 156.

Figure 7:
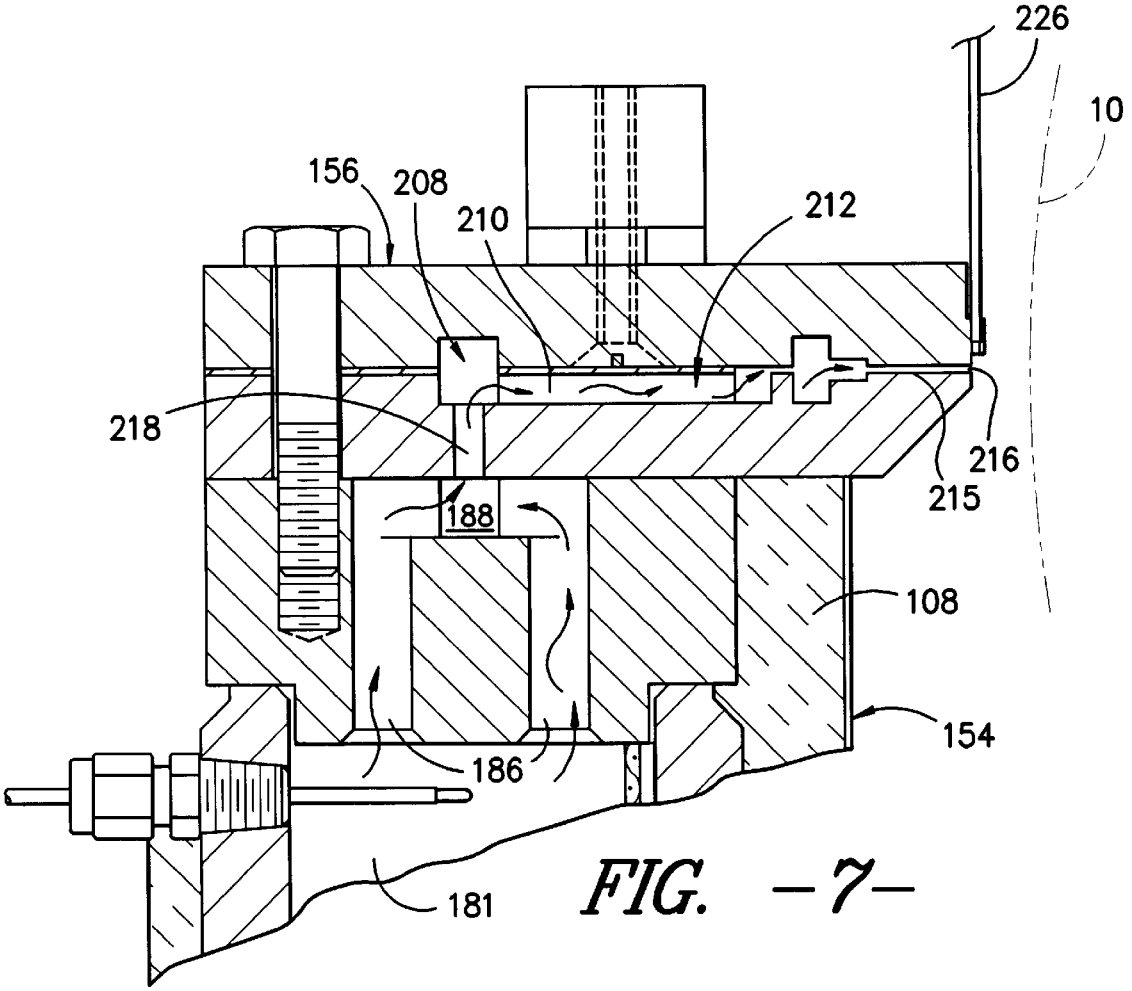
FIG. 7 is an enlarged broken away sectional view of the fluid stream distributing manifold housing of the manifold assembly as illustrated in FIG. 6.

As best seen in FIGS. 6 and 7, manifold housing 154 is provided with a plurality of gas flow passageways 186 which are disposed in uniformly spaced relation along the plate in two rows to connect the first gas receiving compartment 181 with a central elongate channel 188.

Baffle plate 192 serves to define a gas receiving chamber in the compartment 181 having side openings or slots 194 to direct the incoming heated air from the bank of heaters in a generally reversing path of flow through compartment 181. Disposed above channel-shaped baffle plate 192 is compartment 181 between the fluid inlet openings 183 and fluid outlet passageways 186 is an elongate filter member 200 which is a generally J-shaped plate with a filter screen disposed thereabout.

Figure 8:
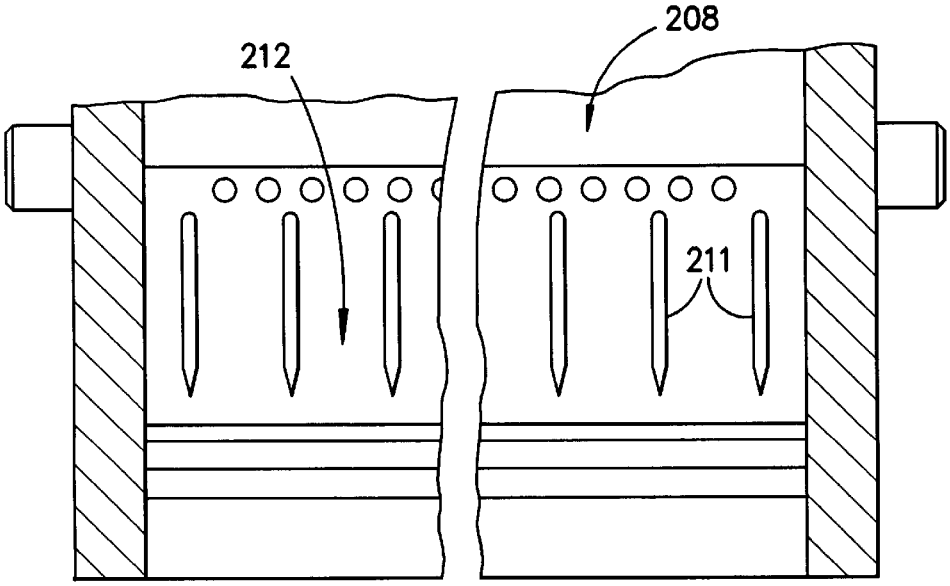
FIG. 8 is an enlarged broken away sectional view of an end portion of the fluid stream distributing manifold housing.

As seen in FIGS. 6, 7 and 8, a second smaller manifold housing 156 comprises first and second opposed elongate wall members, each of which has an elongate recess or channel 208 therein. Wall members are disposed in spaced, coextensive parallel relation with their recesses 208 in facing relation to form upper and lower wall portions of a second gas receiving compartment 210, in the second manifold housing 156. The gas then passes through a third gas receiving compartment 212 in the lower wall member of manifold housing 156 which is defined by small elongate islands 211 approximately uniformly spaced along the length of the member, as shown in FIG. 8. A continuous slit directs heated pressurized air from the third gas receiving compartment 212 in a continuous sheet across the width of the fabric at a substantially right angle onto the surface of the moving textile fabric 10. Typically, in the treatment of textile fabrics such as pile fabrics containing thermoplastic fiber components, the continuous slit 215 of manifold 156 may be 0.015 to about 0.030 of an inch in thickness. For precise control of the heated air streams striking the textile fabric 10, the continuous slit is preferably maintained between about 0.070 to 0.080 of an inch from the textile fabric surface being treated. However, this distance from the face of the textile fabric can be as much as 0.100 of an inch and still produce good pattern definition. The deflecting air tubes 226 are spaced twenty (20) to the inch over the seventy-two (72) inch air distributing manifold, although the apparatus has been constructed as coarse as ten (10) to the inch and as fine as forty-four (44) to the inch.

Second manifold housing 156 is provided with a plurality of spaced gas inlet openings 218 (FIGS. 6 and 7) which communicate with the elongate channel 188 of the first manifold housing 154 along its length to receive pressurized, heated air from the first manifold housing 154 into the second gas receiving compartment 210.

The continuous slit 215 of the second manifold housing 156 which directs a stream of air into the surface of textile fabric 10 is provided with tubes 226 which communicate at a right angle to the discharge axis of continuous slit 215 to introduce pressurized cool air, i.e., air having a temperature substantially below that of the heated air in third gas receiving compartment 212, at the heated gas discharge outlet 216 to deflect selectively the flow of heated air through the continuous slit 215 in accordance with pattern control information. Air passing through the tubes 226 may be cooled by a water jacket which is provided with cooling water from a suitable source, not shown, although such cooling is not required.

As seen in FIG. 5, pressurized unheated air is supplied to each of the tubes 226 from compressor 138 by way of a master control valve 228, pressure regulator valve 229, air line 230, and unheated air header pipe 232 which is connected by a plurality of individual air supply lines 234 to the individual tubes 226. Each of the individual cool air supply lines 234 is provided with an individual control valve located in a valve box 236. These individual control valves are operated to open or close in response to signals from a pattern control device, such as a computer 238, to deflect the flow of hot air through continuous slit 215 during movement of the textile fabric 10 and thereby produce a desired pattern in the textile fabric 10. Detailed patterning information for individual patterns may be stored and accessed by means of any known data storage medium suitable for use with electronic computers, such as magnetic tape, EPROMs, etc.

The foregoing details of the construction and operation of the manifold assembly 130 of the gas treating apparatus are the subject matter of commonly assigned U.S. Pat. No. 4,471,514 issued on Sept. 18, 1984 and U.S. Pat. No. 5,035,031 issued on May 18, 1993. The disclosures thereof is included herein by reference for full description and clear understanding of the improved features of the present invention as if fully set forth herein.

Each cool air fluid tube 226 is positioned at approximately a right angle to the plane defined by slit 215 to deflect heated pressurized air away from the surface of the moving textile fabric 10 (FIG. 6) as the textile fabric approaches continuous slit 215. This deflection is generally at about a forty-five (45) degree angle from the path defined by continuous slit 215, and serves to direct the deflected heated air toward the oncoming textile fabric 10. Thus, a strong blast of mixed hot and cold air strikes the surface of the textile fabric prior to its being subjected to the action of the heated air issuing from continuous slit 215.

This configuration of tubes 226 provides sufficient volume of air in combination with that from the continuous slit 215 to preheat the textile fabric 10 to a temperature preferably short of permanent thermal modification.

It should be noted that, due to the insulation 108 generally surrounding manifold 154, preheating is not believed to be the result of heat radiation from the manifold, but is rather the result of the exposure of textile fabric 10 to the heated air issuing from continuous slit 215, as that air is diverted by the relatively cool air issuing from tubes 226. The heated air used for this purpose is air that has been diverted, in accordance with patterning instructions, after issuing from continuous slit 215, i.e., this air would be diverted whether or not preheating was desired. Therefore, preheating of the textile fabric is achieved as an integral part of, and is inseparable from, the patterning process, and requires no additional or separate heated air source. By so doing, not only is a separate preheating step and its attendant complexity unnecessary, but it is believed a separate preheating step would be incapable of imparting heat of sufficient intensity and directivity to maintain the textile fabric 10 at an effective preheated temperature at the instant the heated patterning air issuing from continuous slit 215 contacts the textile fabric, as shown in FIG. 8.

This preheating may cause additional thermal modification during the patterning step. As can be seen in connection with FIG. 9, the amount of shrinkage is a function of the type of fiber involved and the temperature to which it is subjected. The temperature of the hot air is adjusted to accommodate a particular fiber so that the amount of shrinkage can be controlled regardless of the fabric. The air pressure of the heated gas can range between 0.5 to 10 pounds per square inch with a more practical operating range of 1 to 5 pounds per square inch and a preferred optimal range of 1 to 3 pounds per square inch. The air pressure of the cooler, blocking gas can range between 2 to 18 pounds per square inch with a more practical operating range of 9 to 18 pounds per square inch and a preferred optimal range of 10 to 12 pounds per square inch. The speed of transport of the moving textile web can range between 1 to 25 yards per minute with a more practical operating range of 3 to 18 yards per minute and a preferred optimal range of 6 to 10 yards per minute.

Additional information relating to the operation of such a pressurized, heated gas apparatus, including more detailed description of patterning and control functions, can be found in coassigned U.S. Pat. No. 5,035,031, that issued on Jul. 30, 1991, which is incorporated by reference as if fully set forth herein and coassigned U.S. Pat. No. 5,148,583, that issued on Sep. 22, 1992, which is incorporated by reference as if fully set forth herein and coassigned U.S. Pat. No. 4,393,562, that issued on Jul. 19, 1983, which is incorporated by reference as if fully set forth herein and coassigned U.S. Pat. No. 4,364,156, that issued on Dec. 21, 1982, which is incorporated by reference as if fully set forth herein and coassigned U.S. Pat. No. 4,418,451, that issued on Dec. 6, 1982, which is incorporated by reference as if fully set forth herein.

In the alternative, another nonpreferred means of carving textile fabric, although not the preferred means, is to subject textile fabric to the heat of a laser. Referring now to FIG. 10, which shows, diagrammatically, an overall side elevational view of apparatus for laser treatment of a textile fabric 10 to impart lateral yarn displacement. There is a plurality of textile fabric guide rolls which direct an indefinite length of textile fabric 10, from a fabric supply roll 302, past a laser unit, which is indicated by numeral 320. After treatment, the treated textile fabric 4 is collected in a continuous manner on a take-up roll 316. As shown, textile fabric 10 from supply roll 302 passes over an idler roll 306 to a main driven textile fabric support roll 308. The surface of the textile fabric 10 is hit by the laser beam from laser unit 320 between idler roll 306 and driven treated, textile fabric 4 thereafter passes over a series of driven guide rolls 312, 314 and to take-up roll 316 for collection.

Laser unit 320 is preferable a 10.6 micron wavelength, eighty watt, carbon dioxide laser, although any of a wide variety of lasers will suffice. One typical laser of this type is manufactured by Laser Machining, Inc. that is located at 500 Laser Drive, MS 628, Industrial Park, Somerset, Wis. 54025. Although not specifically limited thereto, the preferred range of moving the textile fabric 10 is a speed of one hundred to two hundred inches per minute.

Other nonpreferred methods of selectively applying heat for carving include an infrared heater tube, microwave, and so forth including all means of selectively applying heat by means of either convection or radiation.

As shown in FIG. 11, the treated textile fabric 4 that has been carved in a patterned arrangement to melt the second, lower melt fibers 7 in a selected area and retain the first, higher melt fibers 8 in that same area so that the color of the first, higher melt fibers 8 will dominate in these select areas and the combined, resulting color from the combination of the first, higher melt fibers 8 and the second, lower melt fibers 7 will dominate in the remaining untreated areas. The first, higher melt fibers 8 will typical shrink, however, they will not melt and still be present to provide a carved effect on the textile fabric 4.

As this invention may be embodied in several forms without departing from the spirit or essential character thereof, the embodiments presented herein are intended to be illustrative and not descriptive. The scope of the invention is intended to be defined by the following appended claims, rather than any descriptive matter hereinabove, and all embodiments of the invention which fall within the meaning and range of equivalency of such claims are, therefore, intended to be embraced by such claims.

What is claimed is:

1. A process for selectively carving color contrasting patterns in textile fabric comprising the steps of:

(a) creating a textile fabric by combining a plurality of first fibers having a first melting point and a first color with a plurality of second fibers having a second melting point and a second color, whereby said first melting point is higher than said second melting point and said blend of said first fibers and said second fibers includes at least ten (10) percent of said first fibers;

(b) selectively applying heat to said textile fabric in order to melt said second fibers in a patterned area thereby revealing the first color of said first fibers in said patterned area in contrast to all unpatterned areas that exhibit a resulting third color based on the blended combination of said first fibers with said first color and said second fibers with said second color.

2. A process for selectively carving color contrasting patterns in textile fabric comprising the steps of:

(a) creating a textile fabric by combining a plurality of first fibers having a first melting point and a first color with a plurality of second fibers having a second melting point and a second color, whereby said first melting point is higher than said second melting point and said blend of said first fibers and said second fibers includes at least thirty (30) percent of said first fibers;

(b) selectively applying heat to said textile fabric in order to melt said second fibers in a patterned area thereby revealing the first color of said first fibers in said patterned area in contrast to all unpatterned areas that exhibit a resulting third color based on the blended combination of said first fibers with said first color and said second fibers with said second color.

3. A process for selectively carving color contrasting patterns in textile fabric comprising the steps of:

(a) creating a textile fabric by combining a plurality of first fibers having a first melting point and a first color with a plurality of second fibers having a second melting point and a second color, whereby said first melting point is higher than said second melting point and said blend of said first fibers and said second fibers includes at least forty (40) percent of said first fibers;

(b) selectively applying heat to said textile fabric in order to melt said second fibers in a patterned area thereby revealing the first color of said first fibers in said patterned area in contrast to all unpatterned areas that exhibit a resulting third color based on the blended combination of said first fibers with said first color and said second fibers with said second color.

4. A process for selectively carving color contrasting patterns in textile fabric comprising the steps of:

(a) creating a pile textile fabric by combining a plurality of first fibers having a first melting point and a first color with a plurality of second fibers having a second melting point and a second color, whereby said first melting point is higher than said second melting point and said blend of said first fibers and said second fibers includes at least ten (10) percent of said first fibers;

(b) selectively applying heat to said pile textile fabric in order to melt said second fibers in a patterned area thereby revealing the first color of said first fibers in said patterned area in contrast to all unpatterned areas that exhibit a resulting third color based on the blended combination of said first fibers with said first color and said second fibers with said second color.

5. A process for selectively carving color contrasting patterns in textile fabric comprising the steps of:

(a) creating a textile fabric by combining a plurality of polyester fibers having a first melting point and a first color with a plurality of polypropylene fibers having a second melting point and a second color, whereby said first melting point is higher than said second melting point and said blend of said polyester fibers and said polypropylene fibers includes at least ten (10) percent of said polyester fibers;

(b) selectively applying heat to said textile fabric in order to melt said polypropylene fibers in a patterned area thereby revealing the first color of said polyester fibers in said patterned area in contrast to all unpatterned areas that exhibit a resulting third color based on the blended combination of said polyester fibers with said first color and said polypropylene fibers with said second color.

6. A process for selectively carving color contrasting patterns in textile fabric comprising the steps of:

(a) creating a textile fabric by combining a plurality of nylon fibers having a first melting point and a first color with a plurality of polypropylene fibers having a second melting point and a second color, whereby said first melting point is higher than said second melting point and said blend of said nylon fibers and said polypropylene fibers includes at least ten (10) percent of said nylon fibers;

(b) selectively applying heat to said textile fabric in order to melt said polypropylene fibers in a patterned area thereby revealing the first color of said nylon fibers in said patterned area in contrast to all unpatterned areas that exhibit a resulting third color based on the blended combination of said nylon fibers with said first color and said polypropylene fibers with said second color.

7. A process for selectively carving color contrasting patterns in textile fabric comprising the steps of:

(a) creating a textile fabric by combining a plurality of rayon fibers having a first melting point and a first color with a plurality of polypropylene fibers having a second melting point and a second color, whereby said first melting point is higher than said second melting point and said blend of said rayon fibers and said polypropylene fibers includes at least ten (10) percent of said nylon fibers;

(b) selectively applying heat to said textile fabric in order to melt said polypropylene fibers in a patterned area thereby revealing the first color of said rayon fibers in said patterned area in contrast to all unpatterned areas that exhibit a resulting third color based on the blended combination of said rayon fibers with said first color and said polypropylene fibers with said second color.

8. A process for selectively carving color contrasting patterns in textile fabric comprising the steps of:

(a) creating a textile fabric by combining a plurality of cellulose fibers having a first melting point and a first color with a plurality of polypropylene fibers having a second melting point and a second color, whereby said first melting point is higher than said second melting point and said blend of said cellulose fibers and said polypropylene fibers includes at least ten (10) percent of said nylon fibers;

(b) selectively applying heat to said textile fabric in order to melt said polypropylene fibers in a patterned area thereby revealing the first color of said cellulose fibers in said patterned area in contrast to all unpatterned areas that exhibit a resulting third color based on the blended combination of said cellulose fibers with said first color and said polypropylene fibers with said second color.

9. A process for selectively carving color contrasting patterns in textile fabric comprising the steps of:

(a) creating a textile fabric by combining a plurality of rayon fibers having a first melting point and a first color with a plurality of polyester fibers having a second melting point and a second color, whereby said first melting point is higher than said second melting point and said blend of said rayon fibers and said polyester fibers includes at least ten (10) percent of said rayon fibers;

(b) selectively applying heat to said textile fabric in order to melt said polyester fibers in a patterned area thereby revealing the first color of said rayon fibers in said patterned area in contrast to all unpatterned areas that exhibit a resulting third color based on the blended combination of said rayon fibers with said first color and said polyester fibers with said second color.

10. A process for selectively carving color contrasting patterns in textile fabric comprising the steps of:

(a) creating a textile fabric by combining a plurality of cellulose fibers having a first melting point and a first color with a plurality of polyester fibers having a second melting point and a second color, whereby said first melting point is higher than said second melting point and said blend of said cellulose fibers and said polyester fibers includes at least ten (10) percent of said cellulose fibers;

(b) selectively applying heat to said textile fabric in order to melt said polyester fibers in a patterned area thereby revealing the first color of said cellulose fibers in said patterned area in contrast to all unpatterned areas that exhibit a resulting third color based on the blended combination of said cellulose fibers with said first color and said polyester fibers with said second color.

11. A process for selectively carving color contrasting patterns in textile fabric comprising the steps of:

(a) creating a textile fabric by combining a plurality of cellulose fibers having a first melting point and a first color with a plurality of nylon fibers having a second melting point and a second color, whereby said first melting point is higher than said second melting point and said blend of said cellulose fibers and said nylon fibers includes at least ten (10) percent of said cellulose fibers;

(b) selectively applying heat to said textile fabric in order to melt said nylon fibers in a patterned area thereby revealing the first color of said cellulose fibers in said patterned area in contrast to all unpatterned areas that exhibit a resulting third color based on the blended combination of said cellulose fibers with said first color and said nylon fibers with said second color.

12. A process for selectively carving color contrasting patterns in textile fabric comprising the steps of:

(a) creating a textile fabric by combining a plurality of rayon fibers having a first melting point and a first color with a plurality of nylon fibers having a second melting point and a second color, whereby said first melting point is higher than said second melting point and said blend of said rayon fibers and said nylon fibers includes at least ten (10) percent of said rayon fibers;

(b) selectively applying heat to said textile fabric in order to melt said nylon fibers in a patterned area thereby revealing the first color of said rayon fibers in said patterned area in contrast to all unpatterned areas that exhibit a resulting third color based on the blended combination of said rayon fibers with said first color and said nylon fibers with said second color.

13. A process for selectively carving color contrasting patterns in textile fabric comprising the steps of:

(a) creating a textile fabric by combining a plurality of polyethylene fibers having a first melting point and a first color with a plurality of second fibers having a second melting point and a second color, whereby said first melting point is higher than said second melting point and said blend of said polyethylene fibers and said second fibers includes at least ten (10) percent of said polyethylene fibers;

(b) selectively applying heat to said textile fabric in order to melt said second fibers in a patterned area thereby revealing the first color of said polyethylene fibers in said patterned area in contrast to all unpatterned areas that exhibit a resulting third color based on the blended combination of said polyethylene fibers with said first color and said second fibers with said second color.

14. A process for selectively carving color contrasting patterns in textile fabric comprising the steps of:

(a) creating a textile fabric by combining a plurality of first fibers having a first melting point and a first color with a plurality of polyethylene fibers having a second melting point and a second color, whereby said first melting point is higher than said second melting point and said blend of said first fibers and said polyethylene fibers includes at least ten (10) percent of said first fibers;

(b) selectively applying heat to said textile fabric in order to melt said polyethylene fibers in a patterned area thereby revealing the first color of said first fibers in said patterned area in contrast to all unpatterned areas that exhibit a resulting third color based on the blended combination of said first fibers with said first color and said polyethylene fibers with said second color.

15. A process for selectively carving color contrasting patterns in textile fabric comprising the steps of:

(a) creating a textile fabric by combining a plurality of first fibers having a first melting point and a first color with a plurality of second fibers having a second melting point and a second color, whereby said first melting point is higher than said second melting point and said blend of said first fibers and said second fibers includes at least ten (10) percent of said first fibers;

(b) selectively applying heat to said textile fabric wherein said a mechanism for selectively applying heat to said textile fabric includes a means for directing at least one stream of pressurized, heated gas at the surface of said textile fabric and a means for selectively interrupting and re-establishing contact between said stream and said textile fabric in accordance with pattern information in order to melt said second fibers in order to melt said second fibers in a patterned area thereby revealing the first color of said first fibers in said patterned area in contrast to all unpatterned areas that exhibit a resulting third color based on the blended combination of said first fibers with said first color and said second fibers with said second color.

16. A process for selectively carving color contrasting patterns in textile fabric comprising the steps of:

(a) creating a textile fabric by combining a plurality of first fibers having a first melting point and a first color with a plurality of second fibers having a second melting point and a second color, whereby said first melting point is higher than said second melting point and said blend of said first fibers and said second fibers includes at least ten (10) percent of said first fibers;

(b) selectively applying heat to said textile fabric wherein said a mechanism for selectively applying heat to said textile fabric includes a laser for directing a laser beam at the surface of said textile fabric and a means for selectively interrupting and re-establishing contact between said laser beam and said textile fabric in accordance with pattern information in order to melt said second fibers in a patterned area thereby revealing the first color of said first fibers in said patterned area in contrast to all unpatterned areas that exhibit a resulting third color based on the blended combination of said first fibers with said first color and said second fibers with said second color.

* * * * *